US007246583B2

(12) United States Patent
Cinpinski et al.

(10) Patent No.: US 7,246,583 B2
(45) Date of Patent: Jul. 24, 2007

(54) METHOD AND APPARATUS FOR DIAGNOSING VALVE LIFTER MALFUNCTION IN A LIFT ON DEMAND SYSTEM

(75) Inventors: Kenneth J. Cinpinski, Ray, MI (US); Vimesh M. Patel, Novi, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 1 day.

(21) Appl. No.: 11/238,720

(22) Filed: Sep. 29, 2005

(65) Prior Publication Data

US 2007/0068474 A1 Mar. 29, 2007

(51) Int. Cl.
*F01L 1/02* (2006.01)

(52) U.S. Cl. ..... 123/90.27; 123/90.17; 123/90.31; 123/198 F; 701/102; 701/105; 701/107

(58) Field of Classification Search ..... 123/90.27, 123/90.31
See application file for complete search history.

(56) References Cited

U.S. PATENT DOCUMENTS 5,529,034 A * 6/1996 Sone et al. ..... 123/90.17
5,537,961 A * 7/1996 Shigeru et al. ..... 123/90.15
6,257,184 B1 * 7/2001 Yamagishi et al. ..... 123/90.15

* cited by examiner

*Primary Examiner*—Thomas Denion
*Assistant Examiner*—Kyle M. Riddle

(57) ABSTRACT

A method for diagnosing malfunctions of switching valve lifters includes sensing variations in pressure of trapped oil in a drive chamber of a hydraulic camshaft drive, such as a cam phaser, comparing peak oil pressure readings in the drive chamber resulting from the increased torque of opening the valves of various cylinders of an engine and identifying cylinders having lower than normal valve opening pressure readings, indicating failure of an associated valve lifter to properly actuate a valve of the cylinder. Apparatus for indicating such malfunctions could include a cam phaser with pressure chamber, a pressure sensor connected to indicate pressure variations in the chamber; and a pressure indicator connected to the sensor and adapted to indicate actual pressure variations for comparison with normal variations to identify low pressure peaks indicating malfunction of a switching lifter. A computer could be used to receive and act upon the malfunction indications.

10 Claims, 4 Drawing Sheets

METHOD AND APPARATUS FOR DIAGNOSING VALVE LIFTER MALFUNCTION IN A LIFT ON DEMAND SYSTEM

TECHNICAL FIELD

This invention relates to a method and apparatus for diagnosing engine valve lifter malfunction in a lift on demand system.

BACKGROUND OF THE INVENTION

It is known in the art, pertaining particularly to vehicle engines, to actuate the valves by a crankshaft driven camshaft having cams which actuate valve lifters either directly or through a suitable valve train. The lifters normally actuate the intake and exhaust valves once each cylinder cycle.

In order to improve fuel efficiency or performance, some engines are provided with valve deactivation lifters, or valve lift profile switching lifters. When actuated, these switching lifters may shut off the valves of the selected cylinders so that the engine runs more efficiently on the other cylinders, which are maintained in operation. In some cases, switching lifters may be used to switch between high and low valve lift operation.

Engines having switching lifters may also be provided with one or more cam phasers, which are generally mounted on the camshafts, and are operated to advance or retard the timing of valve actuation of the intake and/or exhaust valves of the engine. Such cam phasers may be operated by hydraulic vane motors, built into the cam phasers, which rotate the angle of an associated camshaft relative to a driving sprocket in order to change the phase angle of the camshaft relative to the crankshaft phase angle.

The cam phasers may have hydraulic advance and retard drive chambers located within pockets in a drive sprocket and separated by vanes or legs projecting from a rotor mounted on the camshaft. The sprocket drives the camshaft by exerting rotation force or torque on the oil in the advance chambers and the oil acts against the vanes to rotate the camshaft. To change the camshaft phase angle, oil is shifted in or out of the advance chambers to the retard chambers on the other sides of the vanes so that the rotor is rotated, or changed in angle, relative to the drive sprocket.

SUMMARY OF THE INVENTION

The present invention is based on the recognition that the forces applied by engine camshafts in actuating their valve trains vary significantly from a high value when the camshaft is opening the valves of one of the cylinders, to a low value when the camshaft is closing the valves or rotating between valve opening events. Since the camshaft is driven through the oil in the advance (drive) chambers of the cam phaser, the oil pressure in the advance chambers varies in proportion to the load or torque placed on the camshaft when the cam phaser is rotating the camshaft, and particularly when actuating the valves. Thus, the pressure in the advance chambers increases to a peak whenever the valves of one of the cylinders are being opened.

As it happens, the advance chambers and the retard chambers on the other sides of the vanes are fed with oil through internal passages that connect with a solenoid valve or other suitable valve control. In one form, the solenoid valve has a neutral center position in which the oil feeds to the chambers on both sides of the vanes are cut off so that the oil in both the advance chambers and the retard chambers is trapped. In this condition, the cam phaser remains in a fixed phase position and the advance chamber pressure varies as a function of the torque load on the camshaft.

It is possible to sense the pressures in the chambers on both sides of the valves by installing a pressure sensor in the feed line leading to the advance chamber and also in the feed line leading to the retard chamber on the other side of each vane. The pressures sensed by the sensors can be connected to a computer, such as an engine control module, which can identify the peak pressures that occur each time the camshaft opens the valves of one of the cylinders.

If a switching lifter, driving one or more of the intake or exhaust valves of one of the cylinders, malfunctions, so that one or more of the valves it actuates is not performing the intended lift when called for, the force on the camshaft and, thereby, the pressure in the advance chambers will be different, compared to the forces from opening the valves of the other cylinders which are being actuated properly. Thus, the computer can compare the peak pressures in the chambers. If the advance chambers indicate a low pressure when the valves of one cylinder are being opened, the computer can signal a readout on the dash and set a code in the computer program indicating that a malfunction in a particular switching valve lifter may have occurred. The computer may, to the extent necessary, also control operation of the engine, if a lifter malfunction appears to have occurred, in a manner that will prevent damage to the engine or improper operation thereof, under the conditions believed to be present.

These and other features and advantages of the invention will be more fully understood from the following description of certain specific embodiments of the invention taken together with the accompanying drawings.

DESCRIPTION OF AN EXEMPLARY EMBODIMENT

Figure 1:
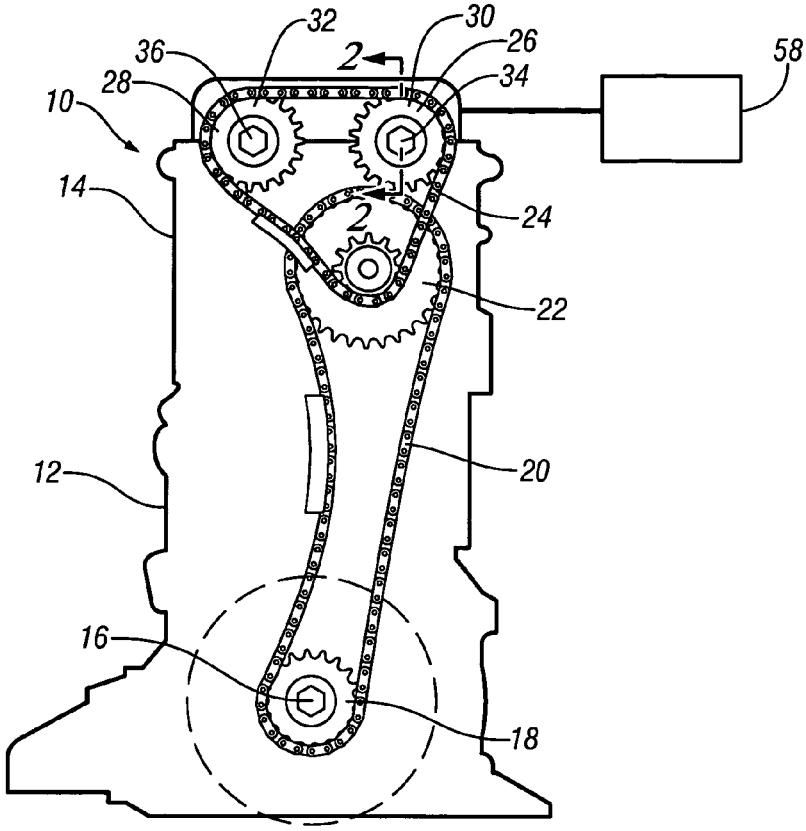
FIG. 1 is a front end view of an automotive engine having lifter malfunction diagnostic apparatus in accordance to the invention.

Referring now to the drawings in detail, numeral 10 generally indicates an automotive engine utilizing the diagnostic method and apparatus of the present invention. Engine 10 includes a conventional cylinder block 12, having a cylinder head 14, conventionally mounted to close upper ends of engine cylinders not shown. The engine includes a crankshaft 16 mounting a drive sprocket 18 and connected through a chain 20 with a transfer member 22 having dual sprockets. The transfer member 22 connects with a second chain 24, which in turn drives two sprockets 26, 28, each incorporating a hydraulically actuated cam phaser 30, 32 for controlling timing of the intake and exhaust valves respectively. The sprockets connect with camshafts 34, 36 including cams, not shown, adapted for actuating the various valves, not shown, in the cylinders of the engine. The intake and exhaust cam phasers 30, 32 are mounted respectively on the ends of the intake and exhaust camshafts 34, 36.

Figure 2:
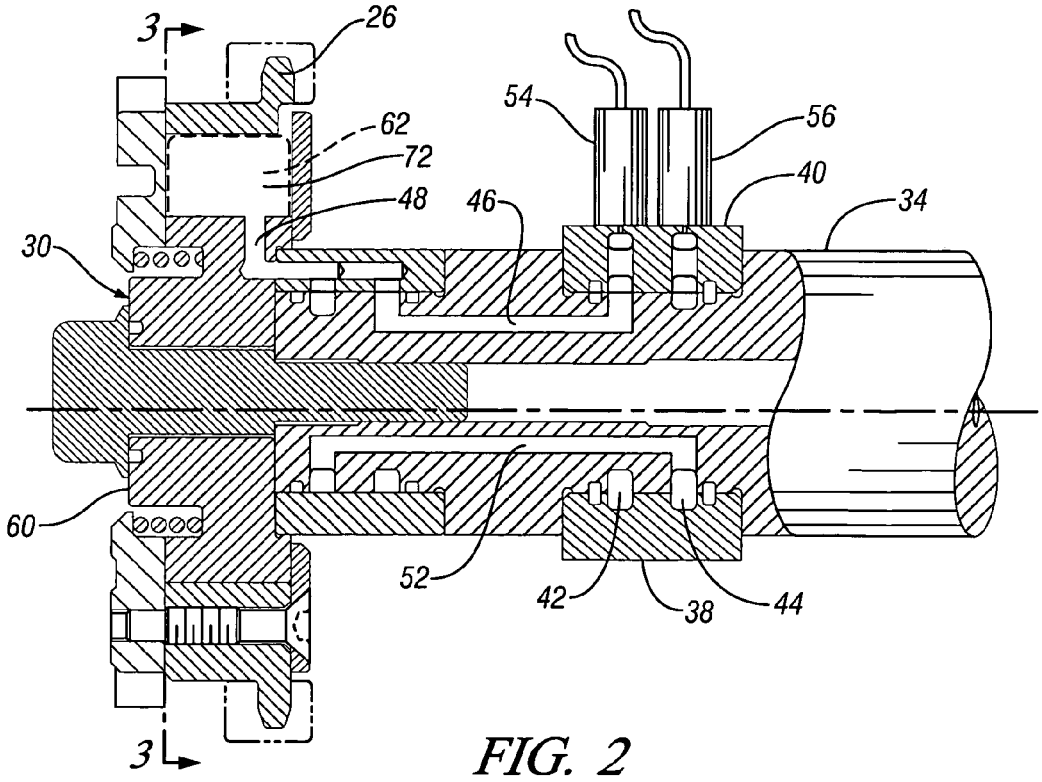
FIG. 2 is a fragmentary cross-sectional view from the plane of the line 2-2 of FIG. 1.

Referring next to FIG. 2 of the drawings, there is shown in partial cross section the intake cam phaser 30 mounted on the end of the intake camshaft 34. The camshaft end is supported by a bearing journal 38 and a corresponding bearing cap 40, which have formed therein advance and retard oil passages 42, 44, respectively. Advance passage 42 connects through a transfer passage 46, with an advance feed passage 48 in the cam phaser 30 to be subsequently more fully described. Retard passage 44, connects through a transfer passage 52 with passages in the cam phaser best shown in FIG. 3.

Advance and retard pressure sensors 54, 56 are mounted on the bearing cap 40 and connect respectively with passages 42, 44 for sensing advance and retard oil pressures, as will be subsequently more fully described. Sensors 54, 56 connect externally with a computer 58 illustrated schematically in FIG. 1.

Figure 3:
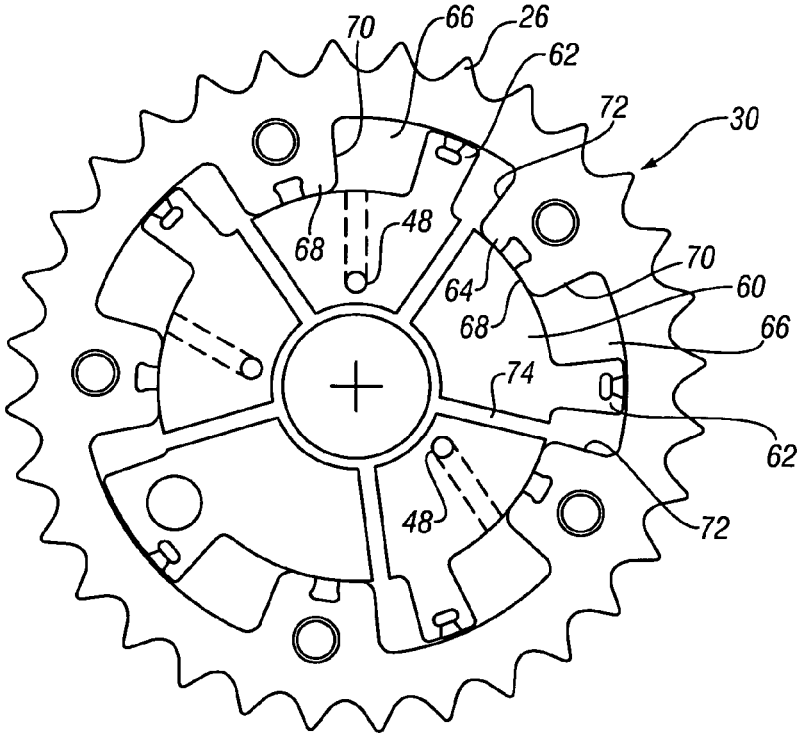
FIG. 3 is a transverse cross-sectional view through the internal chambers of a first embodiment of cam phaser.

Referring now to both FIGS. 2 and 3, the cam phaser 30 is shown to include a central hub 60 fixed to the camshaft 34 and including a plurality of radially extending vanes 62. The intake camshaft sprocket 26 forms an outer portion of the cam phaser 30 and includes a central opening 64 having an inner diameter, carried on the hub 60. The central opening 64 includes a plurality of radially extending pockets 66, separated by a plurality of inwardly extending lands 68. The vanes 62 of the hub 60 subdivide the pockets 66 of the camshaft sprocket 26 into advance and retard chambers 70, 72. The advance chambers 70 are fed with oil though the advance feed passages 48, while the retard chambers 72 are fed with oil through retard feed passages 74, which communicate with retard transfer passages 52.

Figure 4:
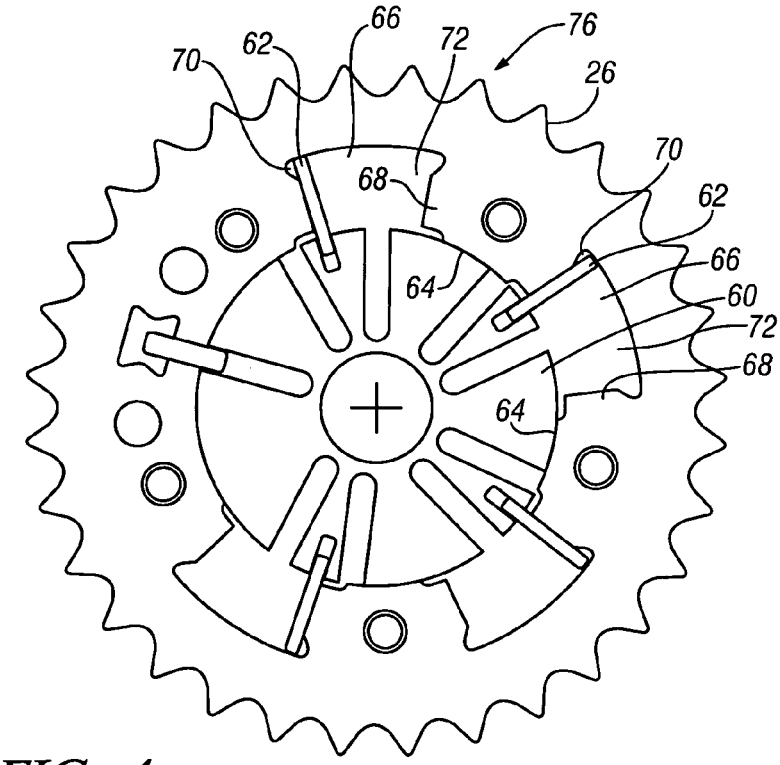
FIG. 4 is a view similar to FIG. 3 showing a second embodiment of cam phaser.

FIG. 4 shows another embodiment of hydraulic cam phaser 76, similar to the cam phaser 30 of FIGS. 2 and 3, wherein like numerals indicate like parts. The cam phaser 76 is provided with a camshaft sprocket 26, which has a central opening 64 rotatable on a hub 60 mounted to the camshaft 34, not shown. The central opening 64 includes a plurality of radially extending pockets 66 separated by a plurality of radially extending lands 68. The hub 60 includes a plurality of radially extendable vanes 62, which subdivide the pockets 66 into advance and retard chambers 70, 72. Other forms of hydraulic cam phasers could be substituted if desired.

Figure 5:
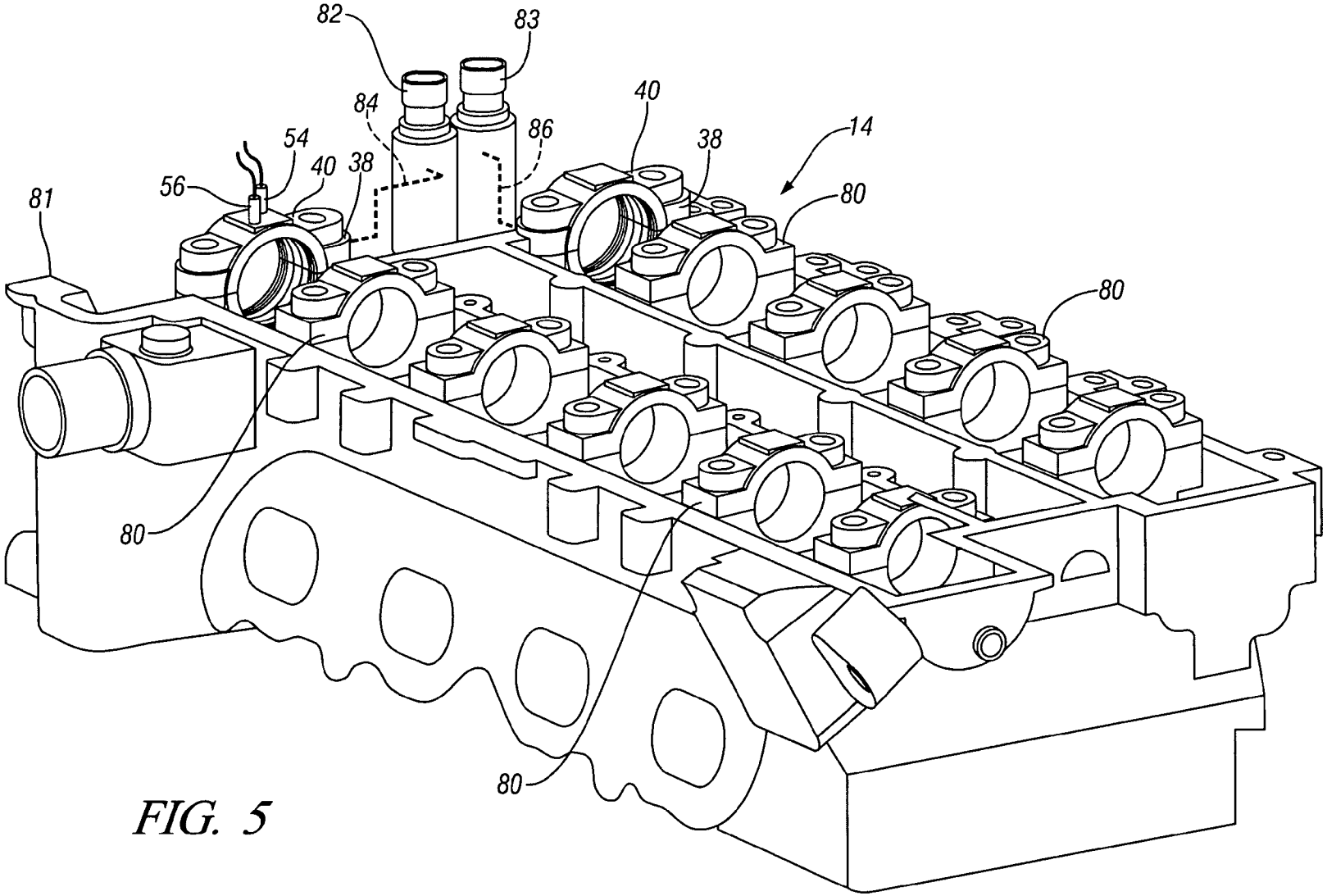
FIG. 5 is a pictorial view of an engine cylinder head showing the cam phaser control valves with lines indicating connection of the valves to passages in the bearing caps of the associated camshaft cam phasers.

FIG. 5 shows the engine cylinder head 14 separated from the cylinder block and before installation of the camshafts, which are supported in a plurality of conventional cam bearing journals and caps 80. Near the front 81, on the left side of the head 14, the bearing journal 38 and bearing cap 40 are mounted, which contain the advance and retard oil feed passages 42, 44 for the intake camshaft 34. An identical journal 38 and cap 40 are mounted on the right side of the cylinder head for the exhaust camshaft 36. Pressure sensors 54 and 56 are mounted in the intake camshaft bearing cap 40 as shown in FIG. 2. Similar sensors could be used in the exhaust bearing cap if desired.

Also, near the front 81 of the cylinder head there are mounted two solenoid valves 82, 83. Valve 82 is connected by internal passages indicated by dashed line 84 with the advance and retard passages 42, 44 in the left side bearing journal and cap 38, 40. The other solenoid valve 83 is internally connected by similar passages indicated by dashed line 86 to the right side bearing journal 38 and cap 40.

In operation of the assembled components, the crankshaft 16 rotates both camshafts, through the chains 20, 24 and the transfer member 22, in a clockwise direction as shown in FIGS. 1, 3 and 4 of the drawings. Referring to the intake camshaft 34, the phase angle of the camshaft relative to the crankshaft may be advanced by actuating the associated solenoid valve 82 in a direction to feed oil through the advance feed passage 48 to the advance (drive) chambers 70, while at the same time draining oil from the retard chambers 72. This causes the camshaft to rotate clockwise, as shown in the figures, to a position similar to that shown in FIG. 3, although it could be moved further clockwise if desired. To again retard the phase angle of the camshaft relative to the crankshaft back to an initial position, the valve 82 is operated in an opposite direction, which feeds oil to the retard feed passage 74 and retard (drive) chambers 72 and drains it from the advance chambers 70 through the advance feed passage 48.

When the camshaft phase is being changed, the pressures in the advance and retard (drive) chambers are controlled by the pressure fed to one of the chambers and by the back pressure, if any, on the discharge of oil from the other of the chambers. However, when the valve moves to a neutral position, which stops advance or retard motion of the camshaft, it also cuts off the flow of oil to or from both the advance and retard chambers, which remain filled with oil.

During engine operation, the rotational force acting on the camshaft is applied to the oil in the advance chambers 70, which applies rotational force clockwise from the lands 68 to the associated vanes 62 on opposite sides of the advance chambers 70. In this condition, the pressures occurring in the advance chambers 70 are conducted through the advance passages 42 to the sensor 54 and are reported to the computer 58. At the same time, the pressures occurring in the retard chambers 72 are carried though the retard passages 44 to the retard sensor 56 and also, if desired, are reported to the computer 58.

When the oil in the chambers is trapped, the pressure in the advance chambers varies generally directly with the torque applied to drive the camshaft in phase with the rotation of the engine crankshaft. Conversely, the pressure in the retard chambers varies generally opposite to the camshaft drive torque. Thus, either pressure could be used to determine changes in the camshaft drive torque that are be associated with opening of the valves of each cylinder and thus indicate, by a reduction in pressure change, whether any of the valves has failed to be opened when it should have been opened. Such a case is illustrated by reference to FIG. 6.

Figure 6:
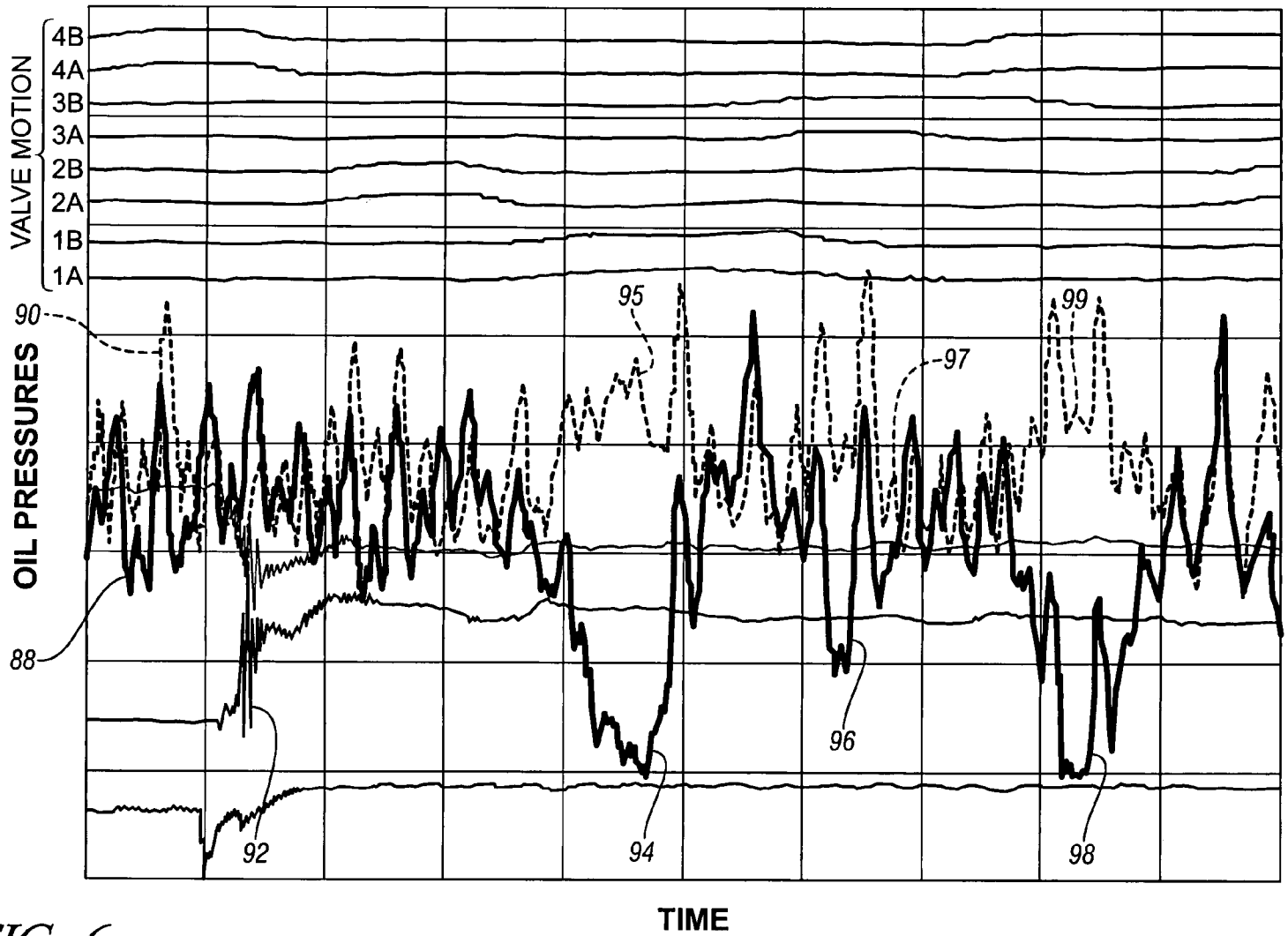
FIG. 6 is a copy of an oscilloscope trace showing variations in cam phaser chamber pressures of an operating engine with a reduced pressure signal indicating a malfunction on one of the cylinders.

FIG. 6 shows oscilloscope traces of the pressures in the passages connected with the advance and retard chambers of a cam phaser driving the intake camshaft of an engine equipped with switching valve lifters. The traces show the pressures when the engine is operating during the switching of the valves to full valve lift and valve opening on the chamber pressures. The heavy solid line 88 represents the pressure of the oil trapped in the advance chambers and passages of the cam phaser. The lighter dashed line 90 represents the pressure of the oil trapped in the retard chambers and passages of the cam phaser.

At numeral 92, the valve lifter oil pressures are increased to cause the switching lifters for the intake valves of cylinders 1, 3 and 4 to switch opening of the valves to full lift. At numerals 94 and 98, the spikes indicate increased oil pressures resulting from the increased torque applied to the camshaft to open the intake valves of cylinders 1 and 4. These spikes show that the lifters fully opened both intake valves of their cylinders. This is confirmed by the corresponding opposite pressure spikes in the retard chambers shown at numerals 95 and 99.

At numeral 96, the smaller spike in oil pressure in the advance chambers indicates that one of the switching lifters for cylinder 3 has failed to fully open its valve. This is confirmed by the reduced pressure drop in the retard chambers of the cam phaser at numeral 97, where both intake valves for the cylinder should have been fully opened. As further confirmation, lines 1A-4B show proximity probe readings, which indicate that intake valve 3A failed to fully open while intake valve 3B was fully opened.

At this point, the comparatively low pressure readings for the cylinder 3 lifter action would indicate to the computer 58 (FIG. 1) that a malfunction of a switching lifter has occurred. The computer would then take proper action to record and notify the operator that a check of the engine operation may be required.

The described embodiment included the use of pressure sensors and pressure traces for both the advance and retard chambers of the cam phaser in order to indicate and confirm the operation of the invention. However, it should be apparent that a single pressure sensor connected with only the advance chambers (for example) of the cam phaser, may be sufficient to indicate a malfunction of a switching lifter in the system for purposes of a production application of the invention in an operating vehicle.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A method for diagnosing malfunctions of switching valve lifters in a lift on demand system of an engine having a cam phaser driving a camshaft that actuates the valves through the lifters, the method comprising:

sensing variations in oil pressure in drive chambers of the cam phaser;

comparing peak oil pressure readings in the drive chambers resulting from opening the valves of various cylinders of an engine;

identifying cylinders having lower than normal valve opening pressure readings, indicating failure of an associated valve lifter to properly actuate a valve of the cylinder.

2. A method as in claim 1 wherein the identifying step is performed by a computer.

3. A method as in claim 2 wherein the computer operates to actuate a suitable signal indicating the occurrence of a malfunction.

4. A method as in claim 3 wherein the signal includes an indicator on the vehicle dash panel.

5. A method as in claim 3 wherein the signal includes a code in the vehicle incident recorder designed to direct service personnel to the location of the malfunction.

6. Apparatus for indicating malfunction of a switching lifter in an engine valve train, the apparatus comprising:

a camshaft connected for actuating valves opened by switching valve lifters in some or all cylinders of an engine;

a hydraulic chamber element including a chamber adapted to contain trapped oil through which rotational drive torque is applied to drive the camshaft when actuating open valves of the switching lifter cylinders controlled by the camshaft, the valve opening step causing measurably increased pressures of the oil in the chamber;

a pressure sensor connected to indicate pressure variations in the chamber; and a pressure indicator connected to the sensor and adapted to indicate actual pressure variations for comparison with normal variations to identify low pressure peaks indicating malfunction of a switching lifter.

7. Apparatus as in claim 6 wherein the hydraulic chamber element is a cam phaser connected to drive the camshaft.

8. Apparatus as in claim 6 wherein the pressure indicator is an oscilloscope screen.

9. Apparatus as in claim 6 wherein the pressure indicator is a computer.

10. Apparatus as in claim 9 wherein the computer is connected with at least one of a visual readout, a code setter, and a notification device.

* * * * *